United States Patent [19]

Zinser

[11] Patent Number: 5,060,269

[45] Date of Patent: Oct. 22, 1991

[54] HYBRID SWITCHED MULTI-PULSE/STOCHASTIC SPEECH CODING TECHNIQUE

[75] Inventor: Richard L. Zinser, Schenectady, N.Y.

[73] Assignee: General Electric Company, Schenectady, N.Y.

[21] Appl. No.: 353,855

[22] Filed: May 18, 1989

[51] Int. Cl.[5] ..... G10L 5/00

[52] U.S. Cl. ..... 381/38; 381/36

[58] Field of Search ..... 381/36–41, 381/29–35

[56] References Cited

U.S. PATENT DOCUMENTS

| | | | |
|---|---|---|---|
| 3,872,250 | 3/1975 | Coulter | 381/39 |
| 4,457,013 | 6/1984 | Castellino et al. | 381/46 |
| 4,776,014 | 10/1988 | Zinser, Jr. | 381/38 |
| 4,817,155 | 3/1989 | Briar et al. | 381/36 |
| 4,890,328 | 12/1989 | Prezas et al. | 381/38 |
| 4,962,536 | 10/1990 | Satoh | 381/49 |

OTHER PUBLICATIONS

Atal et al., "A Pattern Recognition Approach to Voiced-Unvoiced-Silence Classification with Applications to Speech Recognition," Jun. 1976, IEEE Transactions on Acoustics, Speech and Signal Processing, vol. ASSP-24, No. 3, pp. 201–211.

Thomson, "A Multivariate Voicing Decision Rule Adapts to Noise Distortion, and Spectral Shaping," Proceedings: ICASSP 87, pp. 6.10.1–6.10.4.

Kroon et al., "Strategies for Improving the Performance of CELP Coders at Low Bit Rates", *Proc. of 1988 IEEE Int. Conf. on Acoustics, Speech and Signal Processing,* Apr. 1988, pp. 151–154.

Schroeder et al., "Code Excited Linear Prediction (CELP): High Quality Speech at Very Low Bit Rates", *Proc. of 1985 IEEE Int. Conf. on Acoustics, Speech and Signal Processing,* Mar. 1985, pp. 937–940.

Sreenivas, "Modelling LPC Residue by Components for Good Quality Speech Coding," *Proc. of 1988 IEEE Int. Conf. on Acoustics, Speech and Signal Processing,* Apr. 1988, pp. 171–174.

Dal Degan et al., "Communications by Vocoder on a Mobile Satellite Fading Channel", *Proc. of IEEE Int. Conf. on Communications,* Jun. 1985, pp. 771–775.

Areseki et al., "Multi-Pulse Excited Speech Coder Based on Maximum Crosscorrelation Search Algorithm", *Proc. of IEEE Globecom 83,* Nov. 1983, pp. 794–798.

Singhal et al., "Amplitude Optimization and Pitch Prediction in Multipulse Coders", *IEEE Trans. on Acoustics, Speech and Signal Proceeding,* 37, Mar. 1989, pp. 317–327.

Atal et al., "A New Model of LPC Excitation for Producing Natural Sounding Speech at Low Bit Rates", *Proc. of 1982 IEEE Int. Conf. on Acoustics, Speech and Signal Processing,* May 1982, pp. 614–617.

*Primary Examiner*—Dale M. Shaw
*Assistant Examiner*—M. Doerrler
*Attorney, Agent, or Firm*—Lawrence P. Zale; James C. Davis, Jr.; Marvin Snyder

[57] ABSTRACT

Improved unvoiced speech performance in low-rate multi-pulse coders is achieved by employing a multi-pulse architecture that is simple in implementation but with an output quality comparable to code excited linear predictive (CELP) coding. A hybrid architecture is provided in which a stochastic excitation model that is used during unvoiced speech is also capable of modeling voiced speech by use of random codebook excitation. A modified method for calculating the gain during stochastic excitation is also provided.

8 Claims, 4 Drawing Sheets

HYBRID SWITCHED MULTI-PULSE/STOCHASTIC SPEECH CODING TECHNIQUE

CROSS-REFERENCE TO RELATED APPLICATION

This application is related in subject matter to Richard L. Zinser application Ser. No. 07/353,856 filed 5/18/89 for "A Method for Improving the Speech Quality in Multi-Pulse Excited Linear Predictive Coding and assigned to the instant assignee. The disclosure of that application is incorporated herein by reference.

BACKGROUND OF THE INVENTION

1. Field of the Invention

The present invention generally relates to digital voice transmission systems and, more particularly, to a simple method of combining stochastic excitation and pulse excitation for a low-rate multi-pulse speech coder.

2. Description of the Prior Art

Code excited linear prediction (CELP) and multi-pulse linear predictive coding (MPLPC) are two of the most promising techniques for low rate speech coding. While CELP holds the most promise for high quality, its computational requirements can be too great for some systems. MPLPC can be implemented with much less complexity, but it is generally considered to provide lower quality than CELP.

Multi-pulse coding is believed to have been first described by B. S. Atal and J. R. Remde in "A New Model of LPC Excitation for Producing Natural Sounding Speech at Low Bit Rates", *Proc. of* 1982 *IEEE Int. Conf. on Acoustics, Speech. and Signal Processing*, May 1982, pp. 614–617, which is incorporated herein by reference. It was described to improve on the rather synthetic quality of the speech produced by the standard U.S. Department of Defense LPC-10 vocoder. The basic method is to employ the linear predictive coding (LPC) speech synthesis filter of the standard vocoder, but to use multiple pulses per pitch period for exciting the filter, instead of the single pulse used in the Department of Defense standard system. The basic multi-pulse technique is illustrated in FIG. 1.

At low transmission rates (e.g., 4800 bits/second), multi-pulse speech coders do not reproduce unvoiced speech correctly. They exhibit two perceptually annoying flaws: 1) amplitude of the unvoiced sounds is too low, making sibilant sounds difficult to understand, and 2) unvoiced sounds that are reproduced with sufficient amplitude tend to be buzzy, due to the pulsed nature of the excitation.

To see how these problems arise, the cause of the second of these two flaws is first considered. In a multi-pulse coder, as the transmission rate is lowered, fewer pulses can be coded per unit time. This makes the "excitation coverage" sparse; i.e., the second trace ("Exc Signal") in FIG. 2 contains few pulses. During voiced speech, as shown in FIG. 2, this sparseness does not become a significant problem unless the transmission rate is so low that a single pulse per pitch period cannot be transmitted. As seen in FIG. 2, the coverage is about three pulses per pitch period. At 4800 bits/second, there is usually enough rate available so that several pulses can be used per pitch period (at least for male speakers), so that coding of voiced speech may readily be accomplished. However, for unvoiced speech, the impulse response of the LPC synthesis filter is much shorter than for voiced speech, and consequently, a sparse pulse excitation signal will produce a "splotchy", semi-periodic output that is buzzy sounding.

A simple way to improve unvoiced excitation would be to add a random noise generator and a voiced/unvoiced decision algorithm, as in the standard LPC-10 algorithm. This would correct for the lack of excitation during unvoiced periods and remove the buzzy artifacts. Unfortunately, by adding the voiced/unvoiced decision and noise generator, the waveform-preserving properties of multi-pulse coding would be compromised and its intrinsic robustness would be reduced. In addition, errors introduced into the voiced/unvoiced decision during operation in noisy environments would significantly degrade the speech quality.

As an alternative, one could employ simultaneous pulse excitation and random codebook excitation similar to CELP. Such a system is described by T. V. Sreenivas in "Modeling LPC-Residue by Components for Good Quality Speech Coding", *Proc. of* 1988 *IEEE Int. Conf. on Acoustics, Speech. and Signal Processing*. April 1988, pp. 171–174, which is incorporated herein by reference. By simultaneously obtaining the pulse amplitudes and searching for the codeword index and gain, a robust system that would give good performance during both voiced and unvoiced speech could be provided. While this technique appears to be feasible at first look, it can become overly complex in implementation. If an analysis-by-synthesis codebook technique is desired for the multi-pulse positions and/or amplitudes, then the two codebooks must be searched together; i.e., if each codebook has N entries, then $N^2$ combinations must be run through the synthesis filter and compared to the input signal. ("Codebook" as used herein refers to a collection of vectors filled with random Gaussian noise samples, and each codebook contains information as to the number of vectors therein and the lengths of the vectors.) With typical codebook sizes of 128 vector entries, the system becomes too complex for implementation of an equivalent size of $(128)^2$ or 16,384 vector entries.

SUMMARY OF THE INVENTION

It is therefore an object of the present invention to provide a solution to the unvoiced speech performance problem in low-rate multi-pulse coders.

It is another object of this invention to provide a multi-pulse code architecture that is very simple in implementation yet has an output quality comparable to CELP.

Briefly, according to the invention, a hybrid switched multi-pulse coder architecture is provided in which a stochastic excitation model is used during unvoiced speech and which is also capable of modeling voiced speech. The coder architecture comprises means for analyzing an input speech signal to determine if the signal is voiced or unvoiced, means for generating multi-pulse excitation for coding the input signal, means for generating a random codebook excitation for coding the input signal, and means responsive to the means for analyzing an input signal for selecting either the multi-pulse excitation or the random codebook excitation. A method of combining stochastic excitation and pulse excitation in an multi-pulse voice coder is also provided and comprises the steps of analyzing an input speech signal to determine if the input signal is voiced or unvoiced—if the input signal is voiced, it is coded by use of multi-pulse excitation while if the input signal is unvoiced, it is coded by use of a random codebook excitation. A modified method for calculating the gain during stochastic excitation is also provided.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawings in which:

FIG. 3 is a block diagram of the hybrid switched multi-pulse/stochastic coder according to the invention.

DETAILED DESCRIPTION OF A PREFERRED EMBODIMENT OF THE INVENTION

Figure 1:
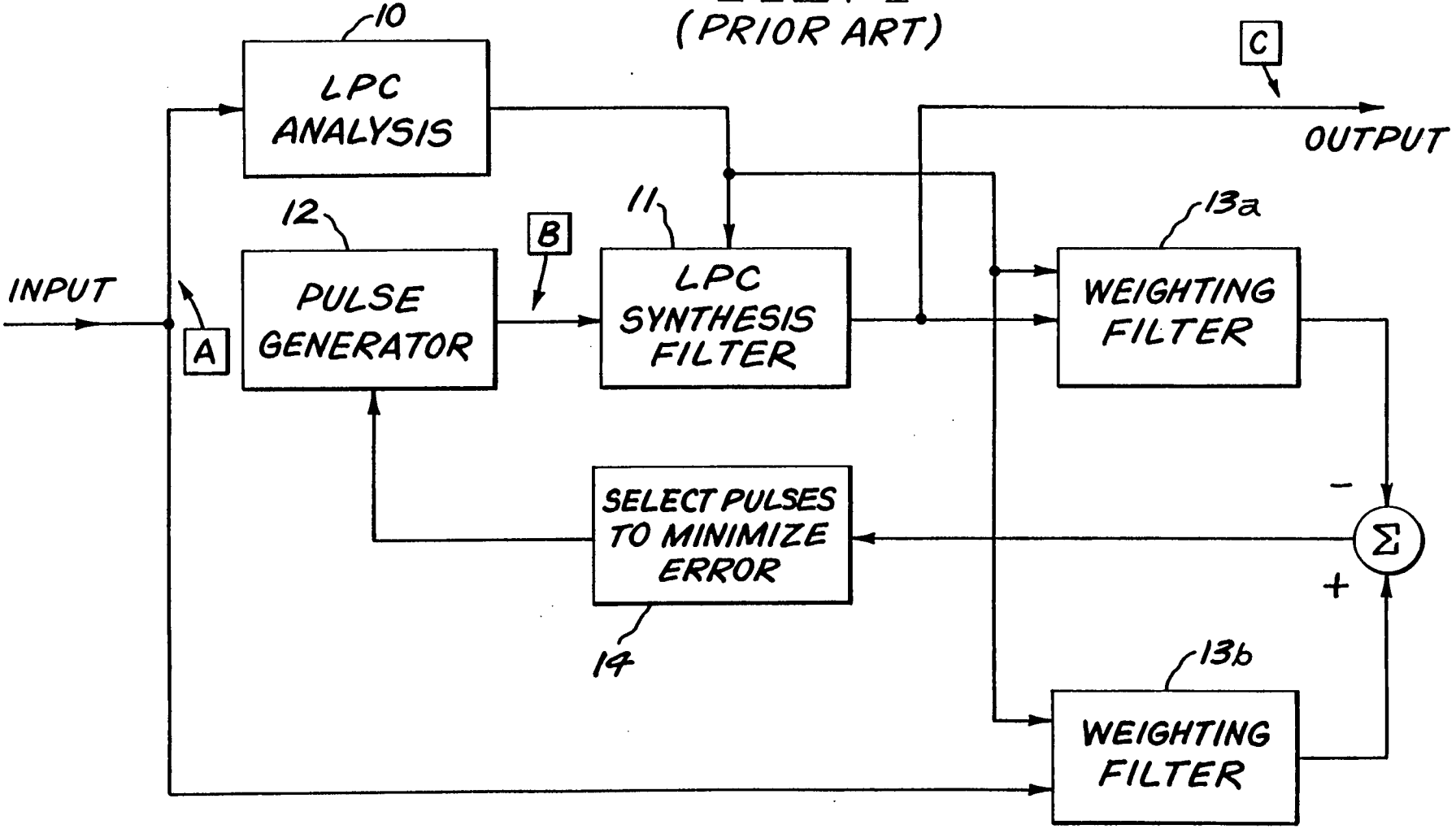
FIG. 1 (PRIOR ART)
FIG. 1 is a block diagram showing the conventional implementation of the basic multi-pulse technique of coding an input signal.
Figure 2:
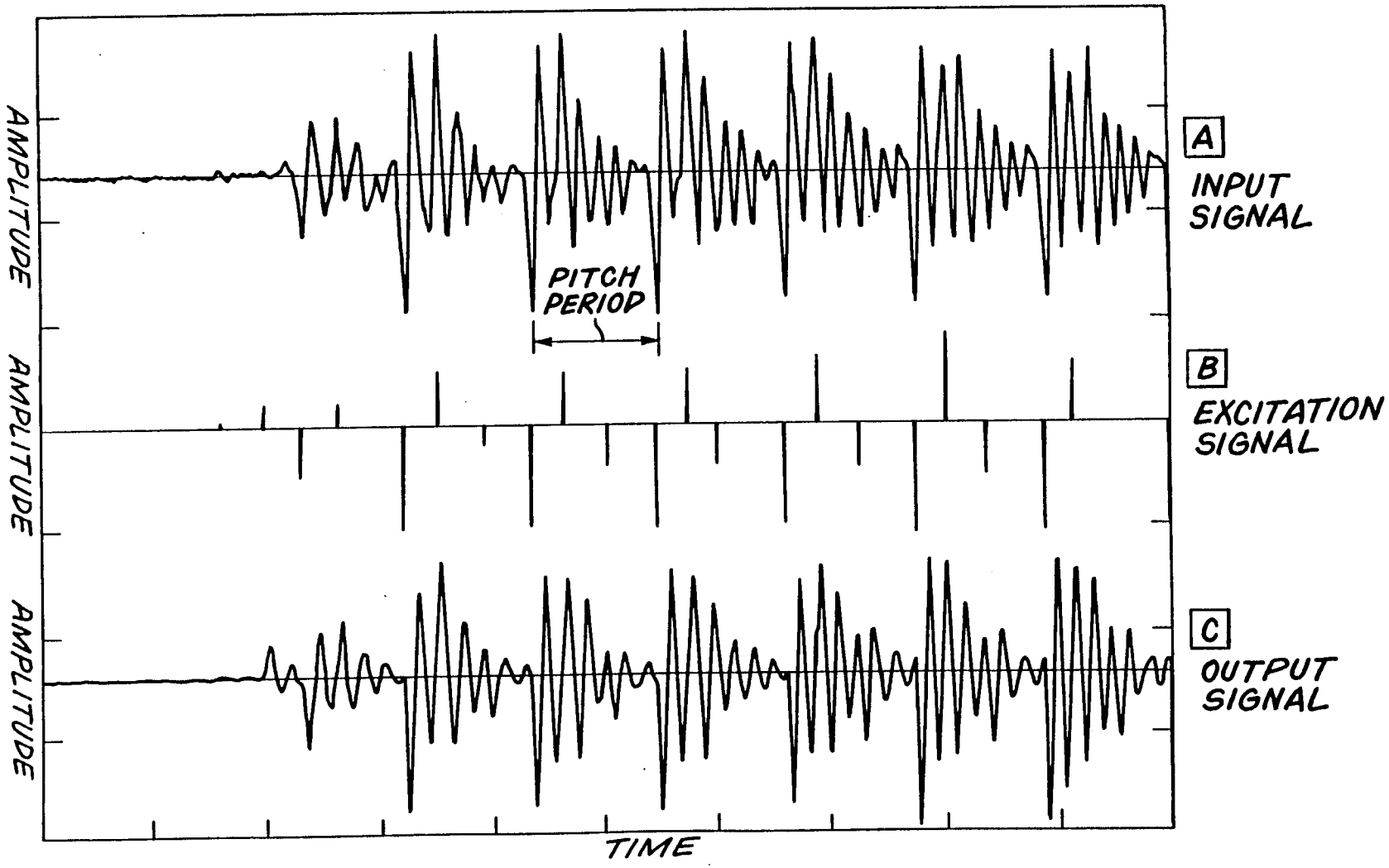
FIG. 2 (PRIOR ART)
FIG. 2 is a graph showing respectively the input signal, the excitation signal and the output signal in the conventional system shown in FIG. 1.

In employing the basic multi-pulse technique using the conventional system shown in FIG. 1, the input signal at A (shown in FIG. 2) is first analyzed in a linear predictive coding (LPC) analysis circuit 10 to produce a set of linear prediction filter coefficients. These coefficients, when used in an all-pole LPC synthesis filter 11, produce a filter transfer function that closely resembles the gross spectral shape of the input signal. A feedback loop formed by a pulse generator 12, synthesis filter 11, weighting filters 13*a* and 13*b*, and an error minimizer 14, generates a pulsed excitation at point B that, when fed into filter 11, produces an output waveform at point C that closely resembles the input waveform at point A. This is accomplished by selecting pulse positions and amplitudes to minimize the perceptually weighted difference between the candidate output sequence and the input sequence. Trace B in FIG. 2 depicts the pulse excitation for filter 11, and trace C shows the output signal of the system. The resemblance of signals at input A and output C should be noted. Perceptual weighting is provided by the weighting filters 13*a* and 13*b*. The transfer function of these filters is derived from the LPC filter coefficients. A more complete understanding of the basic multi-pulse technique may be gained from the aforementioned Atal et al. paper.

Since searching two codebooks simultaneously in order to obtain improvement in unvoiced excitation over that provided by multi-pulse speech coders is prohibitively complex, there are two possible choices that are more feasible; i.e., single mode excitation or a voiced/unvoiced decision. The latter approach is adopted by this invention, through use of multi-pulse excitation for voiced periods and random codebook excitation for unvoiced periods. If a pitch predictor is used in conjunction with random codebook excitation, then the random excitation is capable of modeling voiced or unvoiced speech (albeit with somewhat less quality during voiced periods). By use of this technique, the previously-mentioned reduction in robustness associated with the voiced/unvoiced decision is no longer a critical matter for natural-sounding speech and the waveform-preserving properties of multi-pulse coding are retained. An improvement in quality over single mode excitation is thereby obtained without the expected aforementioned drawbacks.

Listening tests for the voiced/unvoiced decision system described in the preceding paragraph revealed one remaining problem. While the buzziness in unvoiced sections of the speech was substantially eliminated, amplitude of the unvoiced sounds was too low. This problem can be traced to the codeword gain computation method for CELP coders. The minimum MSE (mean squared error) gain is calculated by normalizing the cross-correlation between the filtered excitation and the input signal, i.e., $$g = \frac{\sum_{i=0}^{N-1} y(i)x(i)}{\sum_{i=0}^{N-1} y^2(i)}, \tag{1}$$

where g is the gain, x(i) is the (weighted) input signal, y(i) is the synthesis-filtered (and weighted) excitation signal, and N is the frame length, i.e., length of a contiguous time sequence of analog-to-digital samplings of a speech sample. While Equation (1) provides the minimum error result, it also produces a level of output signal that is substantially lower than the level of input signal when a high degree of cross-correlation between output signal and input signal cannot be attained. The correlation mismatch occurs most often during unvoiced speech. Unvoiced speech is problematical because the pitch predictor provides a much smaller coding gain than in voiced speech and thus the codebook must provide most of the excitation pulses. For a small codebook system (128 vector entries or less), there are insufficient codebook entries for a good match.

If the unvoiced gain is instead calculated by a RMS (root-mean-square) matching method, i.e., $$g = \left[ \frac{\sum_{i=0}^{N-1} x^2(i)}{\sum_{i=0}^{N-1} y^2(i)} \right]^{\frac{1}{2}}, \tag{2}$$

then the output signal level will more closely match the input signal level, but the overall signal-to-noise ratio (SNR) will be lower. I have employed the estimator of Equation (2) for unvoiced frames and found that the output amplitude during unvoiced speech sounded much closer to that of the original speech. In an informal comparison, listeners preferred speech synthesized with the unvoiced gain of Equation (2) compared to that of Equation (1).

FIG. 3 is a block diagram of a multi-pulse coder utilizing the improvements according to the invention. As in the system illustrated in FIG. 1, the input sequence is first passed to an LPC analyzer 20 to produce a set of linear predictive filter coefficients. In addition, the preferred embodiment of this invention contains a pitch prediction system that is fully described in my copending application Ser. No. For the purpose of pitch prediction, the pitch lag is also calculated directly from the input data by a pitch detector 21. To find the pulse information, the impulse response is generated in a weighted impulse response circuit 22. The output signal of this response circuit is cross-correlated with error weighted input buffer data from an error weighting filter 35 in a cross-correlator 23. (LPC analyzer 20 provides error weighting filter 35 with the linear predictive filter coefficients so as to allow cross-correlator circuit 23 to minimize error.) An iterative peak search is performed by the cross-correlator 23 on the resulting cross-correlation, producing the pulse positions. The preferred method for computing the pulse amplitudes can be found in my above-mentioned copending patent application. After all the pulse positions and amplitudes are computed, they are passed to a pulse excitation generator 25, which generates impulsive excitation similar to that shown in trace B of FIG. 2; that is, correlator 23 produces the pulse positions, and pulse excitation generator 25 generates the drive pulses.

Based on the input data, a voiced/unvoiced decision circuit 24 selects either pulse excitation, or noise codebook excitation. If a voiced determination is made by voiced/unvoiced decision circuit 24, pulse excitation is used and an electronic switch 30 is closed to its Voiced position. The pulse excitation from generator 25 is then passed through switch 30 to the output stages.

If, alternatively, an unvoiced determination is made by decision circuit 24, then noise codebook excitation is employed. A Gaussian noise codebook 26 is exhaustively searched by first passing each codeword through a weighted LPC synthesis filter 27 (which provides weighting in accordance with the linear predictive coefficients from LPC analyzer 20), and then selecting the codeword that produces the output sequence that most closely resembles the perceptually weighted input sequence. This task is performed by a noise codebook selector 28. Selector 28 also calculates optimal gain for the chosen codeword in accordance with the linear predictive coefficients from LPC analyzer 20. The gain-scaled codeword is then generated at the codebook output port 29 and passed through switch 30 (which is in the Unvoiced position) to the output stages.

The output stages make up a pitch prediction synthesis subsystem comprising a summing circuit 31, an excitation buffer 33 and pitch synthesis filter 34, and an LPC synthesis filter 32. A full description of the pitch prediction subsystem can be found in the above-mentioned copending application. Additionally, LPC synthesis filter 32 is essentially identical to filter 11 shown in FIG. 1.

A multi-pulse algorithm was implemented with the stochastic excitation and gain estimator described above and as illustrated in FIG. 3. Table 1 gives the pertinent operating parameters of the two coders.

TABLE 1

| Analysis Parameters of Tested Coders | |
|---|---|
| Sampling Rate | 8 kHz |
| LPC Frame Size | 256 samples |
| Pitch Frame size | 64 samples |
| # Pitch Frames/LPC Frame | 4 frames |
| # Pulses/Pitch Frame | 2 pulses |
| Stochastic Excitation in Improved Coder | |
| Pitch Frame Size | same as above |
| Stochastic Codebook Size | 128 entries × 64 samples |

The coders described in Table 1 can be implemented with a rate of approximately 4800 bits/second.

Figure 4:
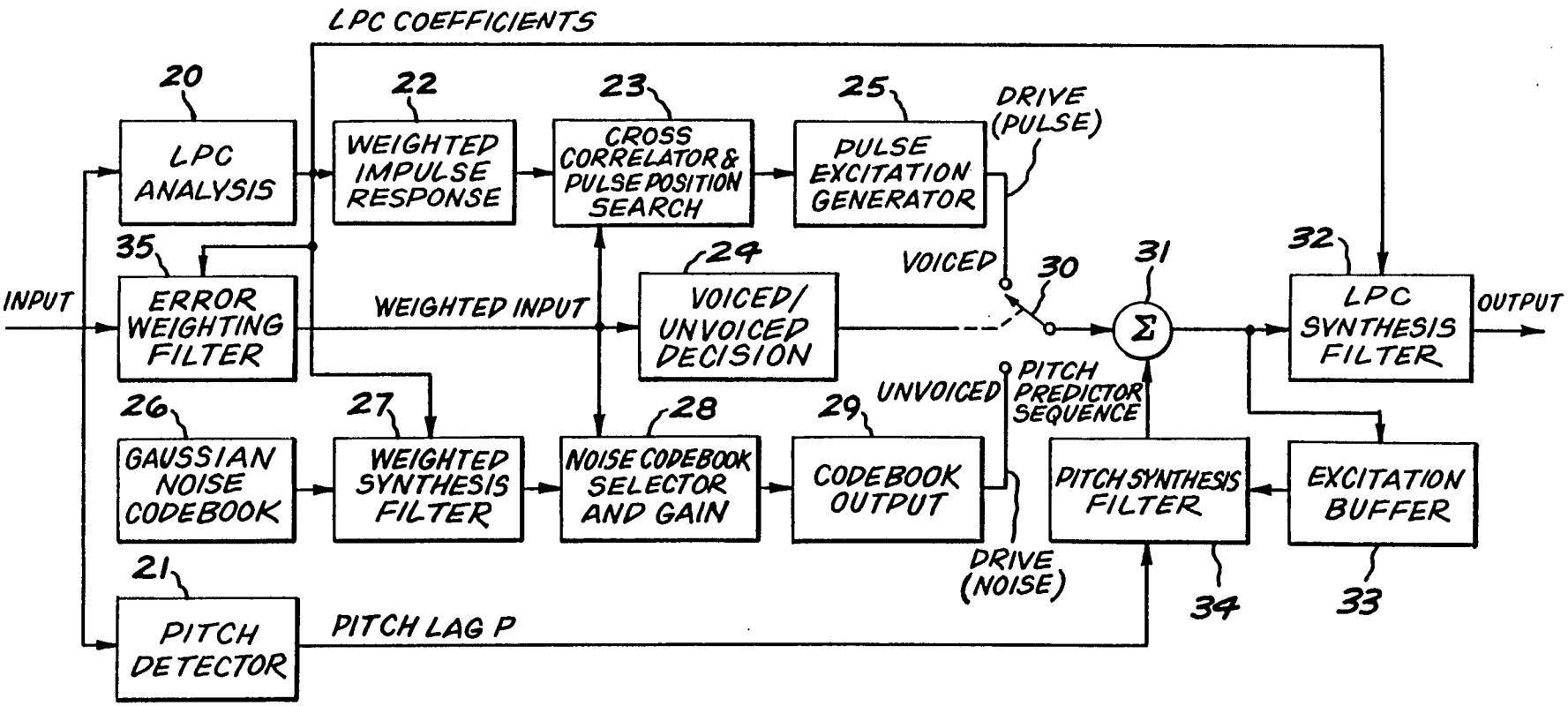
FIG. 4 is a graph showing respectively the input signal, the output signal of a standard multi-pulse coder, and the output signal of the improved multi-pulse coder according to the invention.
Figure 4:
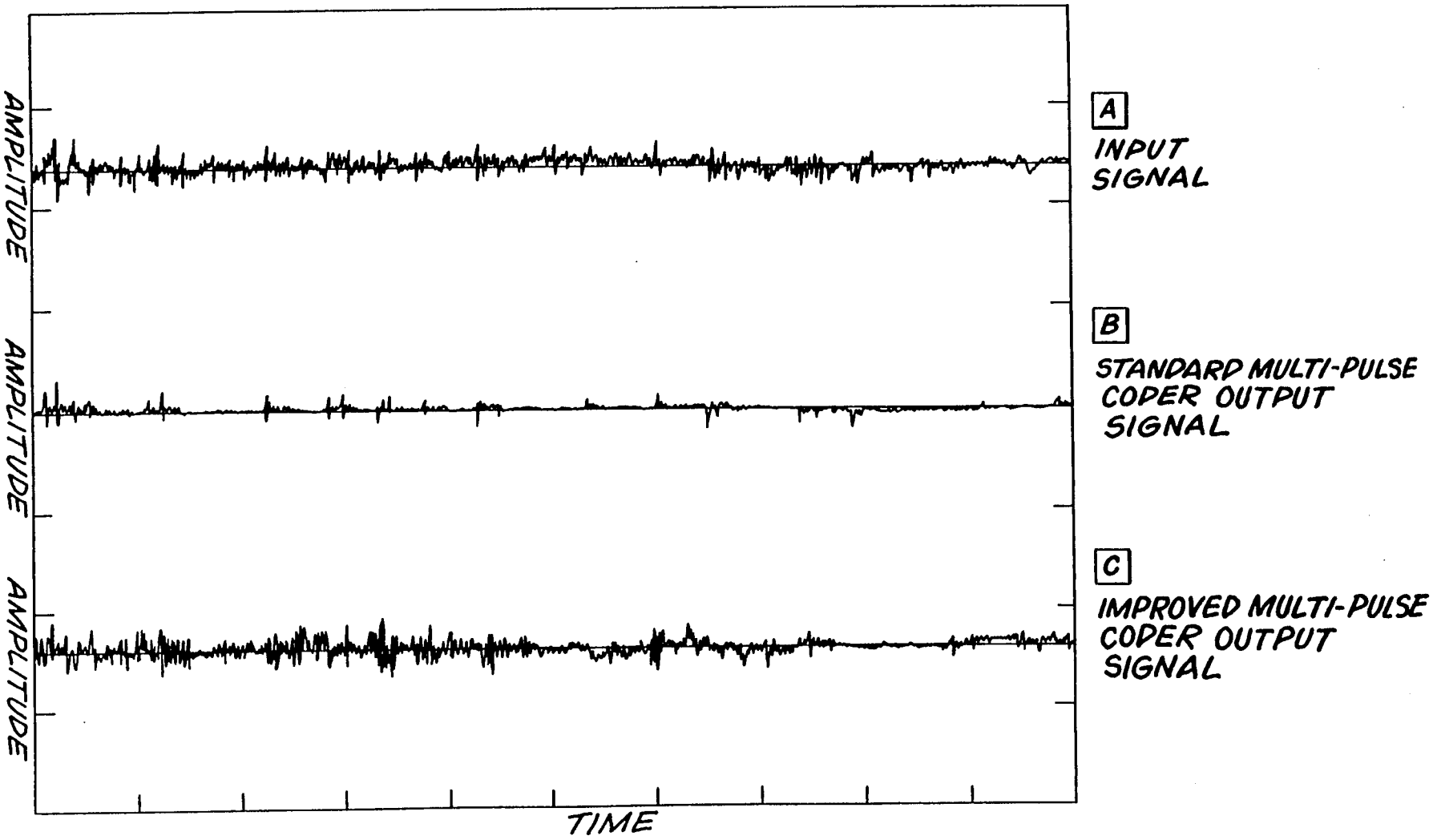

To evaluate performance of the improved system, a segment of male speech was encoded using a standard multi-pulse coder and also using the improved version according to the invention. While it is difficult to measure quality of speech without a comprehensive listening test, some idea of the quality improvement can be had by examining the time domain traces (equivalent to oscilloscope representations) of the speech signal during unvoiced speech. FIG. 4 illustrates those traces. Segment (A) is from the original speech and displays 512 samples, or 64 milliseconds, of the fricative phoneme /s/ (from the end of the word "cross"). Segment (B) illustrates the output signal of the standard multi-pulse coder. Segment (C) illustrates the output signal of the improved coder. It will be noted that segment (B) is significantly lower in amplitude than the original speech and has a pseudo-periodic quality that is manifested in buzziness in the output. Segment (C) has the correct amplitude envelope and spectral characteristics, and exhibits none of the buzziness inherent in segment (B). During informal listening tests, all listeners surveyed preferred the results obtained by the improved system and which are shown in segment (C) over the results obtained by the standard system which are shown in segment (B).

While only certain preferred features of the invention have been illustrated and described herein, many modifications and changes will occur to those skilled in the art. It is, therefore, to be understood that the appended claims are intended to cover all such modifications and changes as fall within the true spirit of the invention.

Having thus described my invention, what I claim as new and desire to protect by Letters Patent is as follows:

1. A method of combining stochastic excitation and pulse excitation in a multi-pulse voice coder to reproduce audible speech, comprising the steps of:

analyzing an input speech signal to determine if the input signal if voiced or unvoiced;

selecting a form of excitation for coding the input signal depending upon the type of input signal, said excitation being multi-pulse excitation if the input signal is voiced and being Gaussian codebook excitation coding if the input signal is unvoiced; and synthesizing said audible speech from the selected form of excitation.

2. The method recited in claim 1 wherein said multi-pulse excitation used for coding a voiced input signal comprises the steps of:

filtering said input speech signal with an error weighting filter to produce a weighted input sequence, passing the input speech signal through linear predictive coding analyzer to produce a set of linear predictive filter coefficients, passing the linear predictive filter coefficients to a weighted impulse response circuit to produce a plurality of pitch buffer samples, storing the pitch buffer samples in a pitch buffer, determining a pitch predictor tap gain as a normalized cross-correlation of the weighted input sequence and the pitch buffer samples by extending the pitch buffer through copying a predetermined number of pitch buffer samples after the last pitch buffer sample in the pitch buffer, modifying a pitch synthesis filter so that a pitch predictor output sequence is a series computed for the predetermined number of samples; and simultaneously solving for a set of amplitudes for excitation pulses and pitch tap gains, thereby minimizing estimator bias in the multi-pulse excitation.

3. A method recited in claim 1 wherein said random codebook excitation used for coding an unvoiced input signal comprises the steps of:

searching a Gaussian noise codebook by passing code words through a weighted linear predictive coding synthesis filter;

selecting a code word that produces an output sequence that most closely resembles the weighted input sequence;

gain scaling the selected codeword; and synthesizing audible portions of speech with the selected codeword.

4. A hybrid switched multi-pulse coder comprising:

means for analyzing an input speech signal to determine if the input signal is voiced or unvoiced;

means for generating multi-pulse excitation for coding an input voiced signal;

means for generating a Gaussian codebook excitation for coding an input unvoiced signal;

output means; and switching means responsive to said means for analyzing an input signal and for selectively coupling to said output means either said multi-pulse excitation or said Gaussian codebook excitation in accordance with whether said input signal is voided or unvoiced.

5. The hybrid switched multi-pulse coder recited in claim 4 wherein said means for generating multi-pulse excitation comprises:

a linear predictive coefficient analyzer;

weighted impulse response means for weighting the output signal of said linear predictive coefficient analyzer;

means responsive to said weighted impulse response means for producing pulse position data;

pulse excitation generator means for generating drive pulses positioned in accordance with said pulse position data to synthesize portions of audible speech; and an error weighting filter for filtering the input signal according to the output signal of the linear predictive coefficient analyzer to produce a weighted input sequence.

6. The hybrid switched multi-pulse coder recited in claim 5 wherein said means for generating a Gaussian codebook excitation comprises:

a Gaussian noise codebook;

a weighted linear predictive coding synthesis filter;

means coupling said Gaussian noise codebook to said weighted linear predictive coding synthesis filter so as to enable searching of said Gaussian noise codebook by passing codewords through said weighted linear predictive coding synthesis filter;

selector means coupled to said weighted linear predictive coding synthesis filter for selecting a codeword that produces an output sequence that most closely resembles the weighted input sequence; and means coupled to said selector means for gain scaling the selected codeword.

7. A method of combining stochastic excitation and pulse excitation in a multi-pulse voice coder to reproduce audible speech, comprising the steps of:

a) analyzing an input speech signal to determine if the input signal if voiced or unvoiced;

b) selecting a form of excitation for coding the input signal depending upon the type of input signal, said excitation being multi-pulse excitation if the input signal is voiced and being Gaussian codebook excitation coding if the input signal is unvoiced;

1. said multi-pulse excitation comprising the steps of:

calculating a weighted input sequence by filtering said input speech signal with an error weighting filter;

calculating a set of linear predictive filter coefficients by passing the input speech signal through linear predictive coding analyzer;

calculating a plurality of pitch buffer samples by passing the linear predictive filter coefficients to a weighted impulse response circuit;

storing the pitch buffer samples in a pitch buffer;

determining a pitch predictor tap gain as a normalized cross-correlation of the weighted input sequence and the pitch buffer samples by extending the pitch buffer through copying a predetermined number of pitch buffer samples after the last pitch buffer sample in the pitch buffer;

modifying a pitch synthesis filter so that a pitch predictor output sequence is a series computed for the predetermined number of samples; and simultaneously solving for a set of amplitudes for excitation pulses and pitch tap gains, thereby minimizing estimator bias in the multi-phase excitation;

2. said random codebook excitation comprising the steps of:

searching a Gaussian noise codebook by passing code words through a weighted linear predictive coding synthesis filter;

selecting a code word that produces an output sequence that most closely resembles the weighted input sequence; and gain scaling the selected codeword; and c) synthesizing said audible speech from the selected form of excitation.

8. A hybrid multi-pulse coder comprising:

a) means for analyzing an input speech signal to determine if the input signal is voiced or unvoiced;

b) means for generating multi-pulse excitation for coding an input voiced signal comprising:

1. a linear predictive coefficient analyzer;

2. weighted impulse response means for weighting the output signal of said linear predictive coefficient analyzer;

3. means responsive to said weighted impulse response means for producing position data; and 4. pulse excitation generator means for generating drive pulses positioned in accordance with said pulse position data to synthesize portions of audible speech;

c) an error weighting filter for filtering the input signal according to the output of the linear predictive coefficient analyzer to produce a weighted input sequence;

d) means for generating a Gaussian codebook excitation for coding and input unvoiced signal comprising:

1. a Gaussian noise codebook;

2. a weighted linear predictive coding synthesis filter;

3. means coupling said Gaussian noise codebook to said weighted linear predictive decoding synthesis filter so as to enable searching of said Gaussian noise codebook by passing codewords through said weighted linear predictive coding synthesis filter;

4. selector means coupled to said weighted linear predictive coding synthesis filter for selecting a codeword that produces an output sequence that most closely resembles the weighted input sequence; and 5. means coupled to said selector means for gain scaling the selected codeword;

e) output means; and f) switching means responsive to said means for analyzing an input signal and for selectively coupling to said output means either said multi-pulse excitation or said Gaussian codebook excitation in accordance with whether said input signal is voided or unvoiced.

* * * * *